US007258934B2

(12) United States Patent
Wigren et al.

(10) Patent No.: US 7,258,934 B2
(45) Date of Patent: Aug. 21, 2007

(54) THERMAL BARRIER COATING AND A METHOD OF APPLYING SUCH A COATING

(75) Inventors: Jan Wigren, Trollhättan (SE); Mats-Olov Hansson, Vargön (SE)

(73) Assignee: Volvo Aero Corporation, Rollhattan (SE)

( * ) Notice: Subject to any disclaimer, the term of this patent is extended or adjusted under 35 U.S.C. 154(b) by 266 days.

(21) Appl. No.: 10/605,372

(22) Filed: Sep. 25, 2003

(65) Prior Publication Data

US 2004/0126599 A1 Jul. 1, 2004

Related U.S. Application Data

(60) Provisional application No. 60/319,573, filed on Sep. 25, 2002.

(51) Int. Cl.
*B32B 19/00* (2006.01)
*B32B 9/00* (2006.01)
*C23C 16/00* (2006.01)

(52) U.S. Cl. ..... 428/699; 428/701; 428/702; 427/248.1

(58) Field of Classification Search ..... 428/699, 428/701, 702; 416/241 B; 427/248.1
See application file for complete search history.

(56) References Cited

U.S. PATENT DOCUMENTS

| | | | | |
|---|---|---|---|---|
| 4,269,903 | A | 5/1981 | Clingman et al. | 428/591 |
| 4,503,130 | A | 3/1985 | Bosshart et al. | 428/632 |
| 5,876,860 | A | 3/1999 | Marijnissen et al. | 428/623 |
| 6,277,448 | B2 * | 8/2001 | Strutt et al. | 427/452 |
| 6,333,118 | B1 | 12/2001 | Alperine et al. | 428/469 |

FOREIGN PATENT DOCUMENTS

| | | |
|---|---|---|
| EP | 0605196 A1 | 7/1994 |
| JP | 6057396 A | 3/1994 |
| WO | WO 0245931 A1 | 6/2002 |

* cited by examiner

*Primary Examiner*—G. Blackwell
(74) *Attorney, Agent, or Firm*—Novak Druce + Quigg, LLP

(57) ABSTRACT

Method and arrangement for providing a ceramic thermal barrier coating, TBC, deposited and attached directly to a metallic substrate (2), or an intermediate bond coating (3) deposited on such a substrate (2). The TBC includes at least two layers, wherein a first, inner TBC layer, that is directly attached to the substrate (2) or bond coating (3), presents a different microstructure than a second, outer TBC layer.

22 Claims, 1 Drawing Sheet

THERMAL BARRIER COATING AND A METHOD OF APPLYING SUCH A COATING

CROSS REFERENCE TO RELATED APPLICATIONS

The present application claims the benefit of U.S. Provisional Application No. 60/319,573 filed 25 Sep. 2002. Said application is expressly incorporated herein by reference in its entirety.

BACKGROUND OF INVENTION

1. Technical Field

The present invention relates to ceramic thermal barrier coatings, commonly referred to by the acronym, TBC, that is deposited and attached directly to a metallic substrate, or upon an intermediate bond coating deposited on, an covering such a substrate.

The invention also relates to a method of applying a TBC on a substrate, the TBC being applied on the substrate or a intermediate bond coating between the substrate and the TBC, preferably by means of thermal spraying of a powder that forms the TBC on the substrate or bond coating.

The invention also relates to metallic substrates and articles coated with such ceramic TBCS. In particular, the present invention concerns substrates and articles that constitute a constructional element operating in a high temperature environment, such as a turbine blade or combustor in a gas turbine engine.

2. Background

The demand for increased operating temperature in gas turbine engines has led to the development of ceramic thermal barrier coatings (TBC) constituted by materials that are deposited onto metallic parts such as turbine blades and that are exposed to high temperature environments. The task of the TBC is typically to thermally insulate metallic part(s) in order to prolong the parts" service life and prevent rapid degeneration due to temperature-severe operative conditions.

Normally an intermediate bond coating such as a MCrAlY-coating is applied to the metallic substrate in order to promote an efficient connection between the TBC and the metallic substrate. The TBC is applied to the bond coating by means of any suitable deposition technique such as thermal (preferably plasma) spraying, physical vapor deposition (PVD), or chemical vapor deposition (CVD).

Accordingly, the TBC should possess a thermal conductivity that is as low as possible and that presents sufficient thermo-mechanical properties such as thermal shock and cycling resistance, as well as be thin in order to save weight and space.

SUMMARY OF INVENTION

It is an object of the present invention to provide a ceramic thermal barrier coating and a method of applying such a coating that results in a TBC that combines the properties of low thermal conductivity, sufficient mechanical strength and low weight.

The method of applying, or depositing such a coating shall be uncomplicated, easily repeated, and promote efficient production of coated substrates in industrial scale; that is, not only on laboratory scales.

The thermal barrier coatings provided according to the present invention constitute a suitable temperature insulating material for metallic construction elements that operate in harsh heat conditions; examples of such metallic construction elements include parts that operate in gas turbine engines, such as the turbine blades or a combustor that are located in extremely high temperature areas.

An object of the invention is achieved by means of a ceramic thermal barrier coating as described hereinabove and that includes at least two layers. A first, inner TBC layer that is directly attached to the substrate or bond coating presents a different microstructure than a second, outer TBC layer. This can be achieved by means of modifying the coating deposition parameters. Embodiment(s) of the invention constitute preferred deposition methods, which are described in greater detail hereinbelow.

According to a preferred embodiment of the invention, the different microstructure includes a different proportion, distribution or even orientation of pores in the first layer as compared to the second layer. Most preferably, the first layer presents less porosity; that is a smaller proportion of pores, than the second layer.

The second layer has a lower thermal conductivity than the first layer, the lower thermal conductivity being derived from the difference in microstructure; furthermore, the first layer has higher strength than the second layer, the higher strength being deriving from the difference in micro-structure. The task of the first layer is to give the ceramic TBC a sufficient mechanical strength and adhesion to the underlying material. Due to its elevated porosity, the second layer does not by itself present a sufficient contribution to the mechanical strength of the TBC. On the other hand, because of the second layer's increased porosity, the second layer guarantees a very low thermal conductivity for the TBC. Preferably, the second TBC layer defines an outer layer directly exposed to the environment.

According to a preferred embodiment of the invention, the first and second layers have the same chemical composition. Exemplary embodiments of TBC configured according to the invention are typically constituted by substantially the same main components or elements, for example zirconia and dysprosia. The exact proportions of the elements of the TBC layers might differ between the first and second layers; but preferably, the elemental proportions are the same for the two layers.

Preferably, the TBC comprises (includes, but is not limited to) stabilized zirconia, present as $ZrO_2$, normally tetragonal or cubic stabilized zirconia. The stabilization of the zirconia can be obtained by means of any of several stabilizers that are well known within the art, such as any metallic oxide selected from the group consisting of erbia, neodymia, gadolinia, yttria, calcia, magindia, scandia and ytterbia, and mixtures of those elements/compounds.

The composition of the TBC can also comprise any metal oxide containing any quadrivalent metallic ion selected from the group consisting of hafnium dioxide, cerium dioxide, uranium dioxide, and mixtures thereof.

The composition of the TBC can also comprise any metal oxide selected from the group consisting of nickel oxide, cobalt oxide, or chromium oxide.

Preferably, however, the zirconia is stabilized by means of dysprosia, $DyO_2$. Typically, the proportion of dysprosia is between 2 and 30 weight-percent, and preferably between 10 and 20 weight-percent.

The thickness of the second layer is preferably greater than that of the first layer; and the thickness of the first layer should be 10-100 micrometers and preferably 40-75 micrometers.

The invention also relates to a coated metallic substrate, characterized in that it comprises a ceramic thermal barrier coating configured and/or manufactured according to the invention(s) described herein.

It should be understood that a bond coating might be sandwiched between the metallic substrate and an exemplary TBC. Such a bond coating can comprise a metal oxide layer on the metallic substrate preferably constituted of alumina. The bond coating may also comprise an aluminide, a platinum aluminide, an MCrAlY alloy or other aluminum-containing alloy coating on the metallic substrate, and possibly a metallic oxide, preferably alumina, layer deposited thereon.

Typically, the metallic substrate is a nickel superalloy or a cobalt superalloy.

Objects of the invention are also achieved by means of the initially defined method, characterized in that at least two layers of ceramic TBC are applied to the substrate or bond coating, and that the powder particles used for applying a first TBC layer adjacent to the substrate or bond coating present a different microstructure than the powder particles used for a subsequently applied second TBC layer.

Preferably, the powder particles used for applying the first TBC layer present a lower porosity than the powder particles used for subsequently applying the second TBC layer onto the coated substrate.

According to a preferred embodiment of the invention, the powder particles to be used for the application of the first TBC layer present a dense sintered structure. In order to achieve such a structure, the inventive method preferably comprises the step of sintering agglomerates of powder grains in order to form the powder particles.

Preferably, the powder particles to be used for the application of the second TBC layer present a porous structure. According to the invention(s), it has been proven to be advantageous if each powder particle comprises an agglomerate of powder grains surrounded by a shell or coating of melted powder material. Such a microstructure might be achieved by including in the method the step of HOSP-treatment of agglomerates of powder grains in order to form the powder particles.

The agglomerates of powder grains that are either sintered or HOSPED are normally produced through a process in which a batch of powder, with a grain size of, for example 0.5-5.0 micrometers, and pref 1.0-2.0 micrometers, is introduced in a liquid mixture that contains a binder, and then let to dry under such conditions that agglomerates with a typical diameter of 10-150 micrometers are formed as the liquid is eliminated.

Further features and advantages of the present invention will be described in, and become evident from the following detailed description.

BRIEF DESCRIPTION OF DRAWINGS

The invention will be further described with reference to the accompanying drawings, in which.

DETAILED DESCRIPTION

Figure 1:
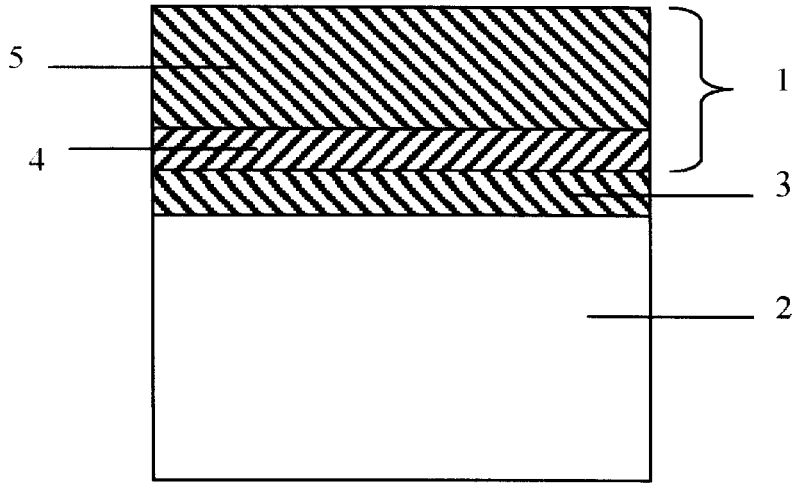
FIG. 1 is a schematic enlarged-scale cross-section depicting a mechanical superalloy article comprising a ceramic heat barrier coating configured according to the invention.

The mechanical article represented in FIG. 1 comprises a ceramic heat barrier coating (TBC) 1 that is deposited on a metallic substrate 2 made of a superalloy in accordance with the disclosed inventive method. As shown, the substrate 2 is also covered by an intermediate metallic underlayer or bond coating 3 that is deposited on the substrate 2 by known processes such as those recognized as PVD, CVD, thermal spraying, and the like.

The bond coating 3 can be an oxide-corrosion-resistant alumino-forming alloy of the McrAlY-type (where M is constituted by Ni and/or Co and/or Fe) or a nickel or cobalt aluminide, optionally modified by the addition of chromium and/or one or more precious metals selected from the group including platinum, palladium, ruthenium, iridium, osmium and rhodium.

A ceramic TBC configured according to the present invention can consist of a zirconia base and a dysprosium oxide for stabilizing the zirconia and reducing the thermal conductivity of the ceramic. To decrease thermal conductivity further, the ceramic can also contain an additional metal oxide comprising a quadrivalent metallic ion having an atomic mass greater than the atomic mass of zirconium ions. The quadrivalent metallic ion may be cerium, hafnium or uranium.

The ceramic TBC is subdivided into two individual layers of substantially the same chemical composition. A first layer 4 attached to the bond coating 3, and a second, outer layer 5 attached to the first layer. The first layer is relatively dense, thereby adhering well to the bond coating and presenting a higher mechanical strength than the second layer 5.

The second layer 5 presents a more open, porous structure than the first layer 4. Due to its porous structure, the second layer has an even further decreased thermal conductivity than would otherwise be the case. However, the price of the improved conductivity (insulative) properties is reduced thermal shock resistance and/or cycling resistance which is remarkably lower than that of the first layer 4.

As a result of their different microstructure, the first and second layers supplement each other with their individual contributions to mechanical strength and low thermal conductivity, respectively.

Figure 2:
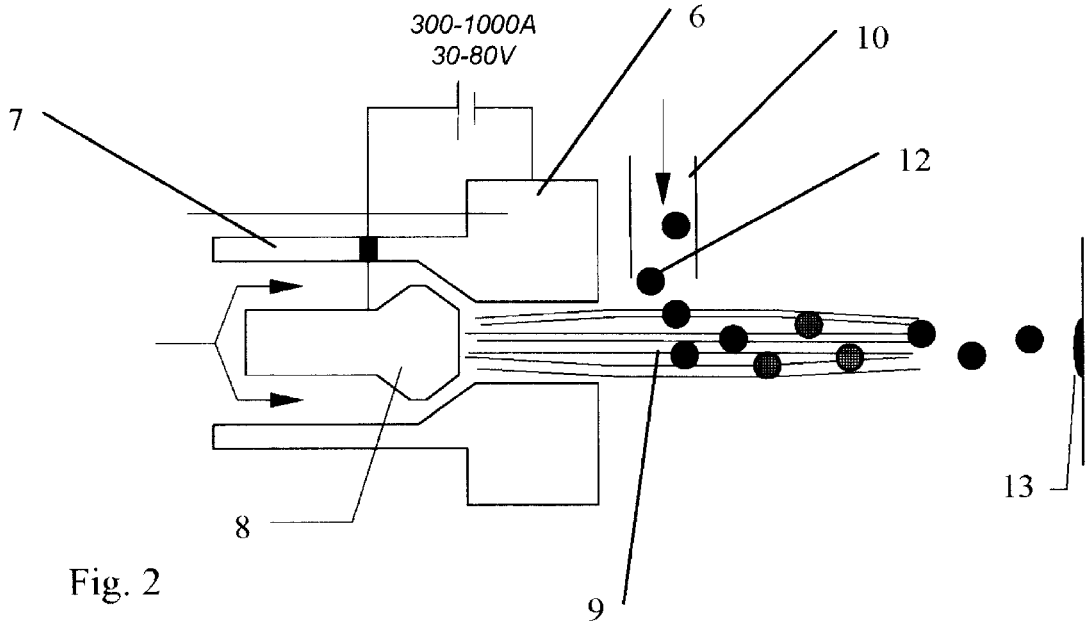
FIG. 2 is a schematic sectional representation of a device for deposition of a coating according to the invention, and operating in accordance with the inventive method described herein.

In the illustrative example, the ceramic TBC is deposited by means of plasma spraying. A plasma spraying device 6 is schematically shown in FIG. 2. The device 6 comprises an anode 7 surrounding a cathode 8 and forming a nozzle for gases. It should be appreciated that this kind of spraying device is well known in the art and needs no further detailed explanation.

An electric arc and a plasma jet 9 is generated by means of the anode 7, cathode 8 and gases flowing through the nozzle. The device further comprises a means 10 for introducing a stream of powder particles 12 into the plasma jet 9. The jet 9 is directed towards a substrate 13 and will transport the powder particles 12 towards the substrate 13 while at the same time at least partly melting the particles 12.

According to the invention, the first TBC layer 4 is formed on the substrate 2, and exemplarily on a bond coating 3 covering the substrate 2, by introducing relatively dense, presintered powder particles 12 into the jet 9. The powder particles 12 used for producing the first layer 4 have been formed by means of a process as described hereinabove that constitutes an agglomeration and sintering procedure.

The particles 12, or at least a substantial or, preferably major part thereof that produce the first layer 4 are fully, or nearly fully melted as they hit the substrate 2/bond coating 3. As a result, the particles 12 form a dense, substantially porous-free layer 4. In the current instance, the terminology of "dense" is used to refer to a less-than-five percent porosity by optical microscopy at less than 200× magnification.

A second layer 5 is subsequently formed by introducing powder particles 12 with a different microstructure than experienced in the first layer 4. The powder particles used to produce the second layer have a more open, porous structure than the first powder particles. Preferably, they have been produced in the way described earlier in the text; that is, by an agglomeration/HOSP process (Homogeneous Oven Spherical Powder) which is a well-known process in the art.

The powder particles 12 for producing the second layer 5 will be only partly melted as they hit the first layer 4 or any other underlying material. Preferably, mainly, predominantly (greater than fifty percent) or exclusively, a previously formed shell or coating surrounding the agglomerated powder particle is melted by the jet 9. As a result, a porous second layer 5 is formed. The porosity is mainly laminar, the pores thereby being flattened out in a plane generally parallel to the plane of the underlying material 2 3, 4. The porosity is above five percent as a contrast to the first layer with its porosity of less than five percent.

In order to perform the steps mentioned above, different spray parameters need to be correctly adjusted. Such parameters include current (voltage), gas flow, powder feed rate, powder temperature, powder velocity, powder size, powder introduction site (in relation to jet and distance to substrate), and substrate temperature.

The above parameters will affect coating properties such as micro-structure hardness, strength, stresses, and the like which will in their turn affect the performance and service life of the ceramic TBC and the coated metallic substrate or article 2.

It should be realized that the above presentation of the invention has been made by way of example, and that alternative embodiments will be obvious for a man skilled in the art. However, the scope of protection claimed is defined in the patent claims supported by the description and the annexed drawings.

The invention claimed is:

1. A ceramic thermal barrier coating, TBC, deposited and attached directly to a metallic substrate (2) or an intermediate bond coating (3) deposited on such a substrate (2), said TBC comprising:

at least two layers (4, 5) wherein a first, inner TBC layer (4) is directly attached to one of a substrate (2) and a bond coating (3) and presents a dense structure with lower porosity than a second, outer TBC layer (5), said second outer layer containing pores which are flattened out and directed substantially in parallel with the substrate, the pores being obtainable by depositing powder particles comprising an agglomerate of powder grains surrounded by a shell of melted powder material.

2. The ceramic thermal barrier coating as recited in claim 1, wherein the second layer (5) has a lower thermal conductivity than the first layer (4), the lower thermal conductivity deriving from the difference in porosity.

3. The ceramic thermal barrier coating as recited in claim 1, wherein the first layer (4) has higher strength than the second layer (5), the higher strength deriving from the difference in porosity.

4. The ceramic thermal barrier coating as recited in claim 1, wherein the second TBC layer (5) defines an outer layer directly exposed to the environment.

5. The ceramic thermal barrier coating as recited in claim 1, wherein the first and second layers (4,5) have the same chemical composition.

6. The ceramic thermal barrier coating as recited in claim 1, further comprising stabilized zirconia.

7. The ceramic thermal barrier coating as recited in claim 1, wherein the ceramic thermal barrier coating has been applied by means of thermal spraying process.

8. The ceramic thermal barrier coating as recited in claim 7, wherein the thermal spraying process comprises plasma spraying.

9. The ceramic thermal barrier coating as recited in claim 1, further comprising a bond coating (3) sandwiched between the substrate (2) and the ceramic thermal barrier coating (1).

10. A method of applying a ceramic thermal barrier coating (1), TBC, on a substrate (2), the TBC being applied on the substrate (2) or an intermediate bond coating (3) between the substrate (2) and the TBC, comprising:

applying at least two layers (4, 5) comprising a first TBC layer and a second TBC layer of ceramic TBC upon one of a substrate (2) and bond coating (3);

wherein the powder particles used for applying a first TBC layer (4) adjacent to one of the substrate (2) and the bond coating (3) present a denser structure with lower porosity than the powder particles used for a subsequently applied second TBC layer (5); and applying the second TBC layer by depositing powder particles comprising an agglomerate of powder grains surrounded by a shell of melted powder material.

11. The method as recited in claim 10, wherein the first and second ceramic TBC layers (4,5) have the same chemical composition.

12. The method as recited in claim 10, wherein the TBC further comprises stabilized zirconia.

13. The method as recited in claim 10, wherein the stabilized zirconia is dysprosia-stabilized zirconia.

14. The method as recited in claim 10, wherein a diameter of the powder particles is 10-150 micrometers.

15. The method as recited in claim 10, wherein the TBC is applied by means of thermal spraying of a ceramic powder on one of the substrate (2) and bond coating (3).

16. The method as recited in claim 10, wherein the TBC is applied utilizing plasma spraying.

17. The method as recited in claim 10, wherein the powder particles that constitute the first TBC layer (4) present a dense sintered structure.

18. The method as recited in claim 17, further comprising sintering agglomerates of powder grains to the powder particles.

19. The method as recited in claim 10, wherein each powder particle comprises an agglomerate of powder grains surrounded by a shell of melted powder material.

20. The method as recited in claim 19, further comprising HOSP-treatment of the agglomerates of powder grains in order to form powder particles.

21. The method as recited in claim 10, wherein a diameter of powder grains forming the powder particles is 0.5-5.0 micrometers.

22. The method as recited in claim 21, wherein the diameter of the powder grains forming the powder particles is 1.0-2.0 micrometers.

* * * * *